United States Patent [19]

Hunt, III

[11] Patent Number: 4,465,138

[45] Date of Patent: Aug. 14, 1984

[54] CYCLIC THERMAL SOLVENT RECOVERY METHOD UTILIZING VISBROKEN PRODUCED CRUDE OIL

[75] Inventor: William C. Hunt, III, Farmers Branch, Tex.

[73] Assignee: Mobil Oil Corporation, New York, N.Y.

[21] Appl. No.: 331,426

[22] Filed: Dec. 16, 1981

[51] Int. Cl.[3] ..... E21B 43/24

[52] U.S. Cl. ..... 166/303; 166/267

[58] Field of Search ..... 166/303, 272, 263, 267

[56] References Cited

U.S. PATENT DOCUMENTS

| | | | |
|---|---|---|---|
| 3,266,569 | 8/1966 | Sterrett | 166/263 |
| 3,354,958 | 11/1967 | Parker | 166/303 |
| 3,358,762 | 12/1967 | Closmann | 166/303 |
| 3,881,550 | 5/1975 | Barry | 166/272 |

*Primary Examiner*—Stephen J. Novosad

*Attorney, Agent, or Firm*—Alexander J. McKillop; Michael G. Gilman; Lawrence O. Miller

[57] ABSTRACT

In a cyclic method of solvent stimulation of a single oil well penetrating a viscous crude oil-containing formation, the well is first produced and a portion of the produced crude oil is subjected to a visbreaking operation to produce a hot visbroken crude oil having reduced viscosity. Production is terminated and a predetermined amount of the hot visbroken produced crude oil is injected into the formation via the well as a solvent, the formation is allowed to undergo a soak period, and the well is returned to production. Thereafter, production may be continued until the percentage of visbroken crude oil in the produced fluids is less than 12 percent and the above cycle may be repeated.

6 Claims, 1 Drawing Figure

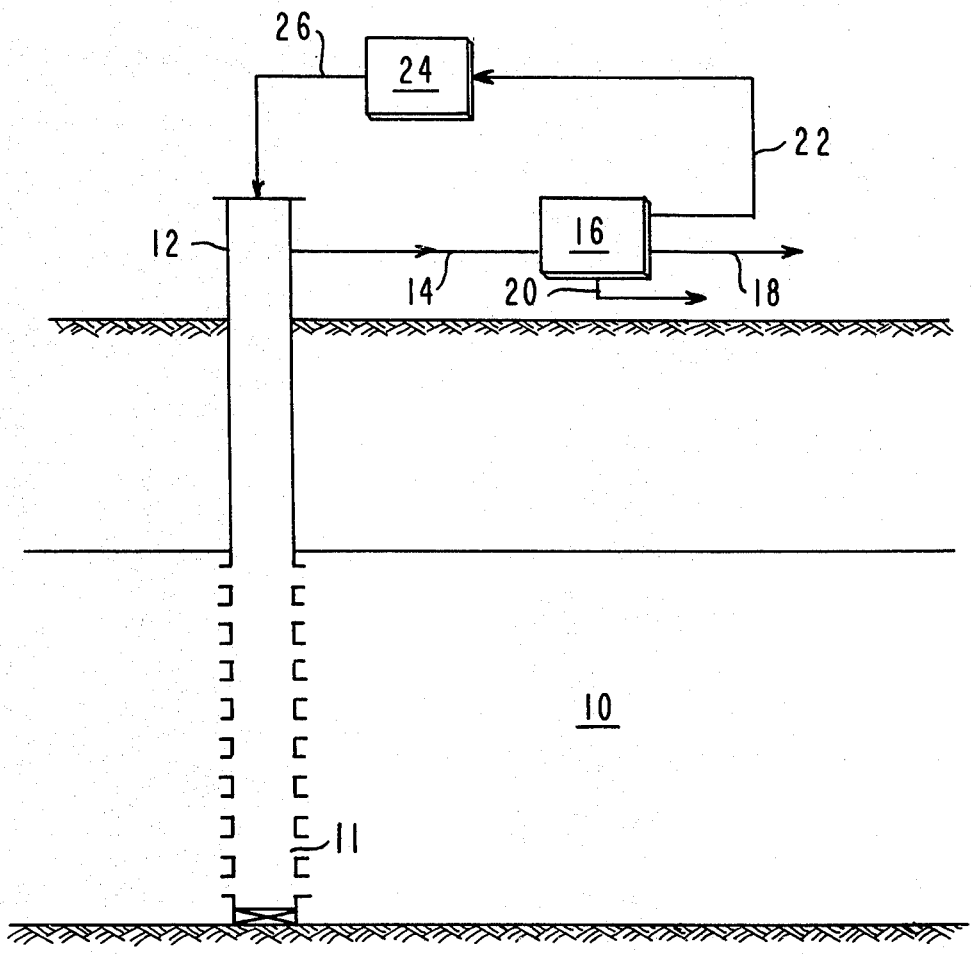
26
24
22
16
12
14
20
18
10
11

CYCLIC THERMAL SOLVENT RECOVERY METHOD UTILIZING VISBROKEN PRODUCED CRUDE OIL

FIELD AND BACKGROUND OF THE INVENTION

1. Field of the Invention

The present invention relates to a cyclic thermal solvent single well stimulation method utilizing hot visbroken produced oil as the solvent injected into the oil formation in order to reduce the viscosity of the oil in the formation and thereby enhance recovery of the oil from the formation.

2. Background of the Invention

Current primary oil production practices fail to recover much of the oil originally in place in natural formations. As a consequence thereof, much effort has been devoted to devising so-called secondary recovery methods of improving the ultimate recovert of the oil in the formations.

Various methods for inducing the recovery of viscous oil from underground formations are in existence. One such method is miscible flooding wherein a solvent for the oil is introduced into the formation and driven through the formation to displace the oil toward a production well from which oil is recovered. The solvents employed in these processes are expensive and the cost of solvent flooding is usually excessive in relation to the oil production obtainable thereby.

In U.S. Pat. No. 3,080,918 to Natland there is disclosed a process for heating produced oil by means of a nuclear reactor and passing the heated oil into the oil formation to reduce the viscosity of the oil and stimulate its recovery. The nuclear reactor is positioned in the well through which the produced oil is injected into the formation.

U.S. Pat. No. 4,174,752 to Slater et al discloses a method for heating recovered crude oil by solar means at the site of recovery thereof and injecting at least a portion of such heated crude oil back into the oil formation in order to reduce the viscosity of oil remaining in the oil formation and thereby allow a greater recovery of crude oil from the formation.

Another recovery technique involves the application of thermal energy in the form of the huff and puff or steam soak process to reduce the viscosity of the oil in the formation. The huff and puff or cyclic steam process is in individual well stimulation process wherein steam is injected into the formation through an injection well, stopping the injection of steam, permitting the formation to soak for a period of time and then back producing oil through the original injection well. As the heated region surrounding the steam injection well cools with time, the stimulation effect declines. As the oil viscosity increases, the well is then re-stimulated by successive steam injection and soaking cycles.

The present application has a relationship to U.S. Application Ser. No. 331,425, by W. C. Hunt, filed concurrently herewith. In Ser. No. 331,425 there is disclosed a thermal solvent method for recovering viscous crude oil from a subterranean, viscous oil-containing formation penetrated by an injection well and a spaced-apart production well. Crude oil is produced from the formation via the production well and a portion of the produced oil is subjected to a visbreaking operation to produce a crude oil having reduced viscosity. The hot visbroken produced oil is injected into the formation via the injection well as a solvent flood to reduce the viscosity of the unrecovered oil remaining in the formation and oil is produced through the production well. Also, a predetermined amount or slug of the hot visbroken produced oil may be injected into the formation via the injection well followed by another fluid such as a liquid or gaseous drive fluid to displace the visbroken produced oil solvent through the formation toward the production well from which oil is produced at an enhanced rate of recovery.

The present method is an improved cyclic thermal solvent single well stimulation method utilizing hot visbroken produced oil as the solvent injected into the formation followed by a soaking period to reduce the viscosity of the oil contained therein and enhance its recovery.

BRIEF DESCRIPTION OF THE DRAWING

The drawing is a schematic view illustrating the present method for cyclic solvent stimulation of a single well utilizing hot visbroken produced crude oil as the solvent.

SUMMARY OF THE INVENTION

This invention involves a method for the cyclic solvent stimulation of a single well to enhance oil recovery from an oil-containing formation. Initially, crude oil is produced from the well and a portion of the produced crude oil is subjected to a visbreaking operation to produce a crude oil having a reduced viscosity within the range of 80 to 95%. Production is terminated and a predetermined amount of the hot visbroken crude oil is injected into the formation via the well as a solvent. Thereafter, the formation is allowed to undergo a soak period for a variable time. The injected hot visbroken crude oil solvent invades the formation and dissolves the oil on contact and dissipates its heat into the formation reducing the viscosity of the oil contained therein. Thereafter, the well is returned to production and fluids including oil and visbroken crude oil are recovered from the formation. When the produced fluids contain less than 12% by volume visbroken crude oil solvent, production may be terminated, and the sequence of injection of hot visbroken crude oil solvent, soak period, and production may be repeated for a plurality of cycles.

DETAILED DESCRIPTION OF THE PREFERRED EMBODIMENTS

The method of my invention may best be understood by referring to the attached drawing, illustrating a subterranean, viscous crude oil-containing formation 10 penetrated by a well 12 in fluid communication with a substantial portion of the formation through perforations 11.

Crude oil is produced from the formation 10 via well 12, drawn off through line 14 and introduced into a storage tank 16. The storage tank 16 is used to temporarily hold the produced crude oil prior to transport of the crude oil to a point of use, transfer or other storage, such as by means of pipe line 18. Any water mixed with the produced oil settles by gravity in storage tank 16 and is withdrawn through line 20. A portion of the produced crude oil, free of water, is withdrawn from tank 16 via line 22 and introduced into a visbreaker 24 and heated therein to a selected temperature, pressure and for a sufficient length of time to produce a crude oil having a reduced viscosity.

Visbreaking, or viscosity breaking, is a process wherein crude oil is pyrolyzed, or cracked, under comparitively mild conditions without significant coke production to provide a product having a lower viscosity. Visbreaking processes include those described in U.S. Pat. Nos. 4,203,830 and 4,233,138 to Rollman et al and as much of these patents as is pertinent is incorporated by reference herein.

It is preferred that the visbreaking operation be conducted at selected temperatures, pressure, and length of heating time sufficient to reduce the viscosity of the produced crude oil within the range of 80 to 95%. The optimum temperature, pressure and heating time required to obtain the desired reduction in viscosity will depend upon the characteristics of the produced crude oil. The viscosity reduction of visbroken produced crude oil may be monitored periodically by taking samples of the visbroken crude oil and measuring its viscosity by suitable means.

Once the produced crude oil has been reduced in viscosity to the desired value, production is terminated and a predetermined amount of slug of hot visbroken crude oil is withdrawn from visbreaker 24 through line 26 and injected into the formation 10 via well 12. The preferred amount of hot visbroken crude oil injected into the formation 10 is about 10 barrels per foot of formation. Once the desired amount of hot visbroken crude oil has been injected into the formation 10, well 12 is shut-in and the formation is allowed to undergo a brief soaking period ranging from a few hours to not more than 24 hours. The injected hot visbroken crude oil invades the formation 10, dissolves viscous oil on contact and dissipates its heat to the formation reducing the viscosity of the oil and mobilizing the oil for enhanced recovery. Thereafter, well 12 is placed on production and fluids including oil mixed with visbroken crude oil solvent are recovered.

Upon initiation of the production cycle, the produced fluids from the formation comprise essentially a mixture of crude oil, water and a large amount of visbroken crude oil solvent. As production continues, the amount of visbroken crude oil in the produced fluids will decrease. Once the percentage of visbroken crude oil in the fluids being produced is less than 12 percent, production may be terminated and the well re-stimulated by the above sequence of injection of hot visbroken crude oil followed by a soak period and fluid production. The solvent stimulation and production cycles may be repeated for a plurality of cycles with each fluid production cycle being terminated when the percentage of visbroken crude oil solvent in the fluids being produced is less than 12 percent.

From the foregoing specification one skilled in the art can readily ascertain the essential features of this invention and without departing from the spirit and scope thereof can adopt it to various diverse applications.

I claim:

1. A method for the recovery of viscous crude oil from a subterranean, viscous crude oil-containing formation penetrated by a well, comprising:

(a) producing crude oil from the formation via said well;

(b) subjecting a portion of said produced crude oil to a thermal visbreaking operation to produce solely by said visbreaking operation a hot visbroken crude oil having a reduced viscosity within the range of 80 to 95 percent;

(c) terminating production and injecting a predetermined amount of said hot visbroken crude oil into the formation via said well to reduce the viscosity of the oil in the formation;

(d) shutting in said well to allow the formation to undergo a soaking period for a variable time;

(e) placing said well on production and recovering fluids including oil from the formation.

2. The method of claim 1 wherein the sequence of steps defined therein are repeated for a plurality of cycles.

3. The method of claim 1 wherein the soak period during step (d) is from a few hours to not more than 24 hours.

4. The method of claim 1 wherein the amount of hot visbroken crude oil injected into the formation during step (c) is ten barrels per foot of formation.

5. The method of claim 1 further including the step of continuing production of fluids from the well until the percentage of visbroken crude oil of said produced fluids is less than 12 percent.

6. The method of claim 5 wherein the sequence of steps defined therein are repeated for a plurality of cycle.

* * * * *